United States Patent [19]

Kastreuz et al.

[11] 4,192,391

[45] Mar. 11, 1980

[54] PISTON FOR A HAMMER DRILL HAVING A SEPARABLE PART

[75] Inventors: Gerhard Kastreuz, Tosters, Austria; Volker Waschk, Münich, Fed. Rep. of Germany

[73] Assignee: Hilti Aktiengesellschaft, Schaan, Liechtenstein

[21] Appl. No.: 912,981

[22] Filed: Jun. 6, 1978

[30] Foreign Application Priority Data

Jun. 30, 1977 [DE] Fed. Rep. of Germany ..... 2729596

[51] Int. Cl.[2] ..... B25D 9/00

[52] U.S. Cl. ..... 173/116; 92/85 R

[58] Field of Search ..... 173/14, 20, 116, 118; 60/537, 594; 92/85 R

[56] References Cited

U.S. PATENT DOCUMENTS 3,032,998 5/1962 Atkinson ..... 173/118

3,884,127 5/1975 Simmons ..... 92/151

FOREIGN PATENT DOCUMENTS 1503206 4/1969 Fed. Rep. of Germany ..... 173/116

2423735 11/1975 Fed. Rep. of Germany ..... 173/116

*Primary Examiner*—Lawrence J. Staab

*Attorney, Agent, or Firm*—Toren, McGeady and Stanger

[57] ABSTRACT

In a hammer drill a pair of pistons are spaced axially apart within a bore forming an air cushion between them. As the rear piston is reciprocated the other piston is also reciprocated and strikes against a drilling tool. The rear piston consists of a hollow cylinder with a headpiece forming an airtight closure across its end surface facing toward the other piston. The headpiece of the rear piston has a part which separates from the remainder of the headpiece when it is struck by the other piston affording communication between the air cushion and the interior of the hollow cylinder.

13 Claims, 8 Drawing Figures

PISTON FOR A HAMMER DRILL HAVING A SEPARABLE PART

SUMMARY OF THE INVENTION

The present invention is directed to a hammer drill having a cylinder in which a first piston is guided and moves in a reciprocal manner by a motor and a second piston is also located within the cylinder forwardly of the first piston so that an air cushion is located between them with the second piston following the reciprocating motion of the first piston and, more particularly, the invention is directed to the structure of the first piston consisting of a hollow cylinder with a headpiece extending across and forming a closure of the end of the hollow cylinder facing toward the second piston.

In known hammer drills using two pistons with an air cushion between them, compensating bores are provided in the cylinder through which losses of the air cushion occurring during normal operation are replaced. In this manner, when the two pistons are properly sealed within the guide cylinder, a sufficient air cushion is maintained between them so that the two pistons do not contact one another. However, due to normal wear, the sealing effect deteriorates and increased leakage losses result from the air cushion. Therefore, as the sealing elements wear out, the forward piston will suddenly strike against the rearward piston. Experience has shown that such contact will result in significant damage to the hammer drill, for example, in addition to damage to the piston rod which reciprocates the rearward piston, other parts of the drive, of the cylinder and of the rearward piston itself would be damaged. There is also the possibility that a damaged part may break through the hammer drill housing and cause injuries to the person operating the drill.

To avoid these problems experienced in the past, it is the primary object of the present invention to produce a hammer drill which discontinues the movement of the forward or second piston when the second piston strikes the first piston. In accordance with the present invention, a separable part is formed in the headpiece of the first piston which separates from the remainder of the headpiece when it is struck by the second piston.

When the separable part is displaced by the kinetic energy of the second piston, the headpiece no longer seals the space between the pistons forming the air cushion, accordingly, the air cushion effect is destroyed. As a result, since the air cushion cannot be maintained, due to the lack of pressure below or an excess of atmospheric, the second or forward piston can no longer follow the movement of the first piston. Once the second piston strikes the first piston further damage is avoided.

Preferably, the separable part is arranged to disengage from the remainder of the headpiece around a desired breaking line. By the appropriate design or strength of the desired breaking line, the force required for separating the separable part can be determined so that blows of relatively small energy can still be absorbed by the first piston without the headpiece rupturing. However, if the action of the second piston striking the headpiece has kinetic energy in excess of the predetermined value, then the separable part will be disengaged and, as a result, the reciprocal movement of the second piston will be stopped. Accordingly, to repair the hammer drill, it is only necessary to replace the first piston with a headpiece forming a closure which can be easily accomplished and does not involve any cost problems as compared to the damage which has occurred in the past. The desired breaking line may, for example, be provided at the location where the headpiece is connected to the remainder of the first piston.

The desired breaking line can be provided where the headpiece is connected to the other parts of the first piston. In one embodiment, the headpiece can be formed as a plug so that the first piston can be reused by merely replacing the plug.

In another embodiment, the breaking line can be in the form of a reduced thickness web, such as a shearing web. This web can be produced by forming a radial recess in the headpiece. However, it is also possible to form the recess as a ring-shaped groove in the face of the first piston directed toward the second piston so that the material remaining in the base of the groove forms the breaking web.

In a preferred arrangement embodying the present invention, one of the surfaces of the two pistons facing the other has an axially extending projection. When the forward or second piston strikes the rearward or first piston, the projection transmits the striking force against the headpiece. If the headpiece forms the projection, the transverse surface of the projection need only form a fraction of the end surface of the first piston, such as the case where the headpiece is a plug or is formed in part by a plug.

To ensure that the first piston which transmits the driving action to the second piston, has a high strength and, thus, a long life despite the incorporation of a separable part into its structure, the connection of the separable part to the piston must have a predetermined strength. In addition, the desired breaking line must reliably fulfill its function, that is, to ensure a predetermined separation in the headpiece. In one embodiment of the invention this requirement can be met by positioning the projection on the headpiece at a position eccentric of the axis of the piston. Accordingly, the breaking line is subject to a bending moment when the forward piston strikes against the rearward one. The separating action where a bending moment is also involved is more sensitive to separation than in the instance where a pure axial force provides the breaking action.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
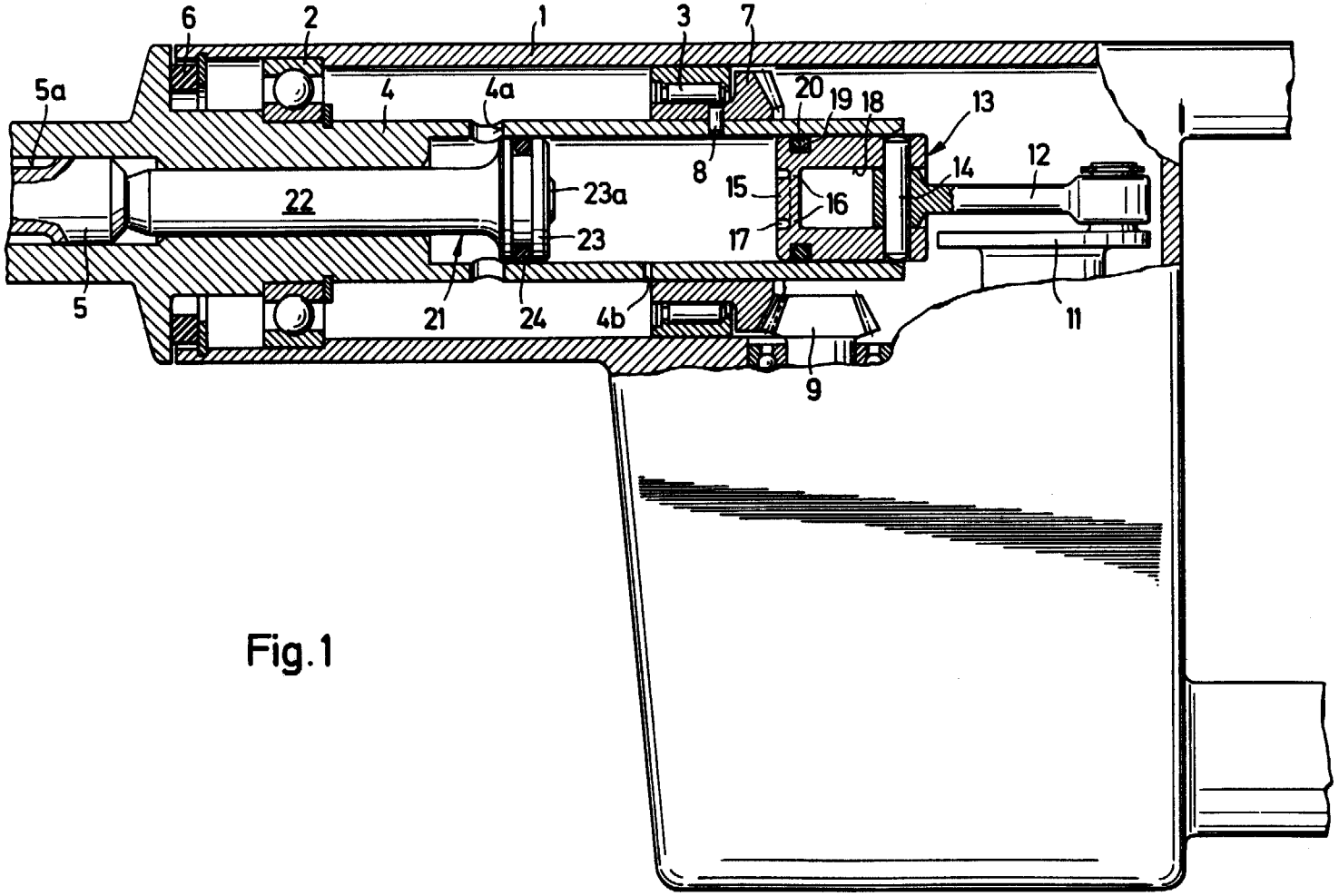
FIG. 1 is a side view, partly in section, of a hammer drill, embodying the present invention, during normal operation.
Figure 2:
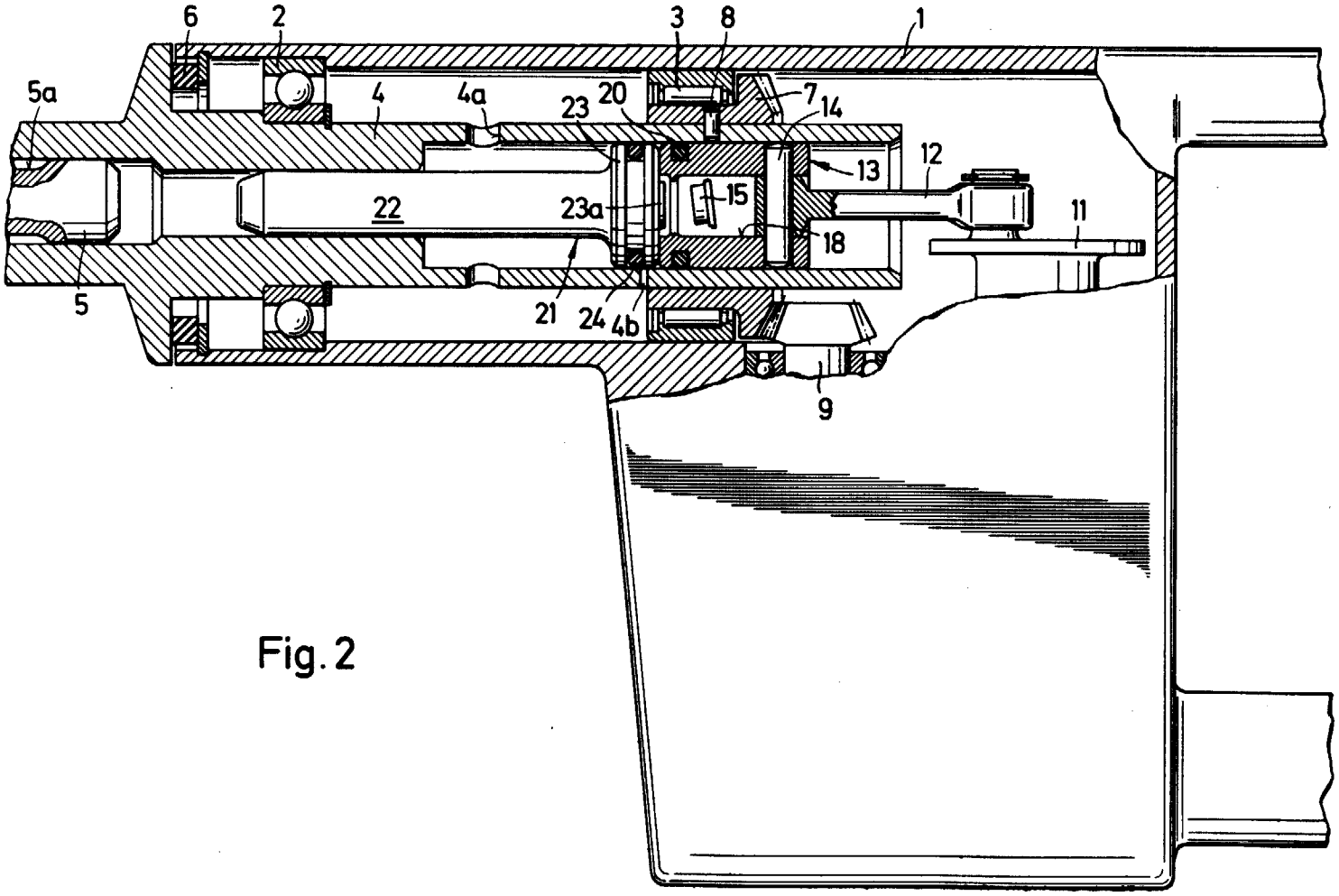
FIG. 2 is a side view, similar to FIG. 1, however, with the forward piston striking the rearward piston with considerable energy.

In FIG. 1 a hammer drill is shown including a housing 1 containing a cylinder rotatably supported by a forward ball bearing 2 and a rearward ball bearing 3. As described, the forward end of the various parts of the hammer drill is that end facing toward the driving direction of the drill, that is in is, leftward direction in FIG. 1 while the rearward end is the oppositely facing end. In its forward end portion, the cylinder 4 is arranged to receive the shank end of a drilling tool 5. Only a portion of the drilling tool is shown in FIGS. 1 and 2. The lateral surface of the shank of the drilling tool 5 has axially extending grooves 5a for receiving connecting elements, not shown. A sealing ring 6 is located between the housing 1 and the cylinder 4 for preventing the passage of dirt into the interior of the drill and also for preventing leakage of lubricants out of the drill.

Within the rearward portion of the housing 1, a bevel gear 7 is mounted on the cylinder 4. The bevel gear is secured to the cylinder 4 by a locking pin 8 so that the gear cannot rotate relative to the cylinder. The rotation of the bevel gear and, as a result, of the cylinder 4, is effected by a bevel pinion driven by a motor, not shown. In addition, an eccentric shaft 11 also driven by the motor imparts axial movement to a first or rear piston 13 through a piston rod 12. The first piston is movably displaceable within the cylinder in the axial direction thereof. The piston rod 12 is coupled to the first piston 13 by a gudgeon pin 14 extending through aligned bores in both parts.

The front end of the first piston 13 includes a headpiece 15 connected to the remainder of the first piston by means of a breaking web 16. The breaking web is formed by the base of an annular recess 17 formed in the front surface of the first piston. The lateral surfaces of the first piston form a hollow cylinder defining a bore 18. The base of the recess 17 reaches close to the end of the bore 18. Further, an annular sealing element 20 is located in the circumferential lateral surface of the first piston 13 in a recess 19 with the sealing element in contact with the inner surface of the cylinder 4. Located forwardly of the first piston 13 within the cylinder 4 is a second piston 21. This second piston has an axially extending shaft 22 for transmitting the force imparted to the second piston, to the drilling tool 5 mounted in the front end of the hammer drill. At its rearward end, the second piston 21 has a transversely extending head 23. Extending circumferentially around the side surface of the head is a sealing element 24 similar to the one provided in the first piston. Moreover, a projection 23a extends axially rearwardly from the head and is concentric with the axis of the cylinder. The diameter of the projection 23a corresponds approximately to that of the headpiece 15. As can be noted in FIG. 1, an air cushion is present between the forward end of the first piston and the rearward end of the second piston during normal operating conditions. As the first piston is reciprocated by the eccentric shaft 11 and the piston rod 12 the second piston 21 has a following reciprocating motion because of the air cushion provided between the two pistons. The seal provided across the hollow interior of the first piston by the headpiece 15 and the sealing action provided by the sealing elements 20 and 24 maintain the air cushion. To avoid any interference with the forward movement of the second piston 21 into the position shown in FIG. 1, the cylinder 4 is provided with blowoff bores 4a adjacent its front end. Furthermore, in the cylinder 4, a compensating bore 4b is provided which, to a limited degree, replaces any leakage losses of the air cushion due to improper sealing action. However, as experience has indicated, with increased operating use of the hammer drill, the effectiveness of the sealing elements 20, 24 is significantly reduced. As a result, the first piston 13 and the second piston 21 move more closely together during each stroke cycle until the faces of the pistons suddenly contact one another. With a weakened sealing effect, the striking energy increases. The strength of the breaking web 16 is predetermined so that it will separate before the kinetic energy imparted by the projection 23a to the headpiece 15 can possibly cause any damage to the piston rod 12 or to any other parts of the hammer drill.

FIG. 2 shows the second piston 21 striking the first piston 13 with the projection 23a having effected the separation of the headpiece 15 from the remainder of the drive piston 13. As a result, the cylindrical space rearwardly of the head 23 of the second piston 21 is directly connected to the outside air through the bore 18 in the first piston 13. Accordingly, an air cushion cannot any longer be formed between the two pistons. Therefore, during the next stroke cycle of the first piston 13, the second piston 21 is pushed into a forward position from which even if the drive piston continues to operate, it cannot be reciprocated by the action of the first piston. Hence, the percussion action acting against the drilling tool is terminated. This action will indicate to a person operating the device that the first piston 13 and the sealing elements 20, 24 need to be replaced.

Contrary to the embodiment of the second piston 21 illustrated in FIGS. 1 and 2, its projection 23a can be arranged eccentrically when an appropriately shaped first piston is used. Additionally, it is also possible to eliminate the elevation 23a on the second piston 21 and to effect the separation of the headpiece from other parts of the first piston solely by an appropriate structural design of the first piston. FIGS. 3 to 7 show first pistons to be used with a second piston 21 which has no projection 23a. In FIGS. 3 to 8, for reasons of simplicity, the piston rod 12, the gudgeon pin 14 and the annular sealing element 20 are not shown.

Figure 3:
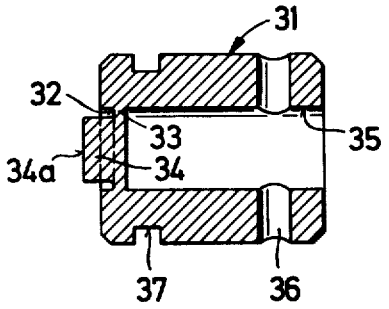
FIGS. 3 to 8 show axial cross-sectional views of various designs of the rearward piston.

In FIG. 3 a first piston 31 is illustrated having a breaking web 33 formed by an axially extending annular recess 32 formed into the transverse front end face of the piston. The annular recess 32 encircles a headpiece 34 which forms a projection 34a integral with headpiece. The projection 34a extends forwardly of the transverse front end face of the first piston 31. A blind bore 35 extends through the piston to the rearward face of the headpiece 34 and serves for the engagement of the piston rod 12. The piston rod 12 is fixed to the piston by means of the gudgeon pin 14 fitted into the cross bore 36. An annular recess 37 in the circumferential side surface of the piston is arranged to receive the sealing element 20.

Figure 4:
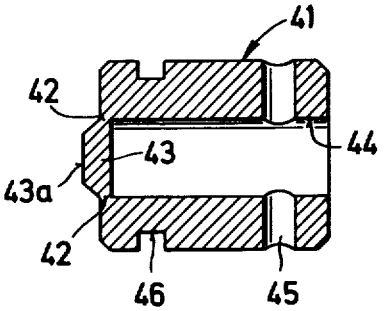

In FIG. 4 another first piston 41 is displayed having a breaking web 42 connecting a headpiece 43 to the hollow cylindrical portion of the piston. The breaking web 42 is formed by limiting the thickness of the closure across the blind bore 44 at the inner surface of the hollow cylinder. A concentric projection 43a is provided by the headpiece 43 extending forwardly of the remaining planar end surface of the piston. A cross bore 45 is provided through the rearward portion of the hollow cylinder for receiving a gudgeon pin 14. Further, an annular recess 46 is formed in the lateral surface of the piston to receive the sealing element 20.

Figure 5:
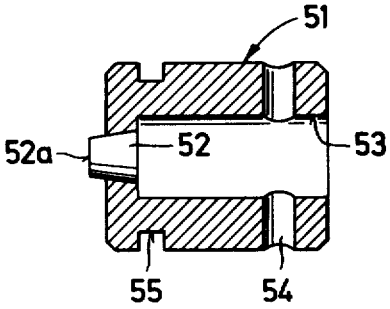

Another first piston 51 is shown in FIG. 5 with the headpiece 52 formed as a tapered plug fitted into an opening in the transverse end surface of the piston. The headpiece 52 can be secured in the opening by an adhesive material or it can be pressed into tightly fitting contact with the opening. In this embodiment, the adhesive or press fit connection forms a separating part which is displaced from the opening when the second piston impacts against the headpiece 52. As can be seen in FIG. 5, the forward end of the headpiece projects beyond the transverse end surface of the drive piston forming a projection 52*a* against which the planar surface of the second piston 21 can act. The drive piston 51 has a bore 53 into which the piston rod 12 is fitted and also a cross bore 54 for receiving a gudgeon pin 14 and an annular recess 55 for the sealing element 20.

Figure 6:
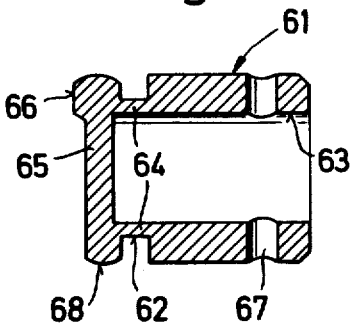

In FIG. 6 another first piston 61 is illustrated with an annular recess 62 extending radially inwardly from the lateral surface of the piston adjacent the front end of the blind bore 63 within the piston. The depth of the recess 62 is such that a braking web 64 is present separating the recess from the forward end of the blind bore 63. Further, the recess 62 also serves to receive the sealing element 20. A headpiece 65 extends transversely across the forward end of the bore 63 affording a seal or closure for the hollow interior of the piston. A projection 66 is provided eccentrically on the radially outer portion of the headpiece 65 and favorably influences the separation of the headpiece at the breaking web 64 when the second piston 21 strikes against the first piston 61. A cross bore 67 is formed in the rearward part of the piston for receiving the gudgeon pin 14.

Figure 7:
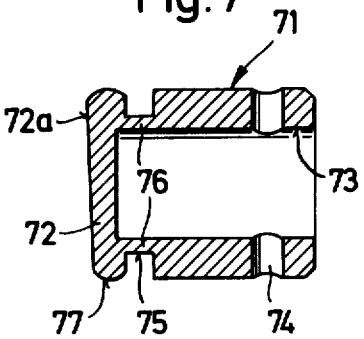

Still another first piston 71 is illustrated in FIG. 7 and is constructed similarly to the one shown in FIG. 6. In contrast to the arrangement shown in FIG. 6, however, in piston 71, a headpiece 72 including a projection 72*a*, formed by a shoulder attachment, has a transverse front end face disposed at an oblique angle to the axis of the piston. A blind bore 73 is provided within the piston 71 to receive the piston rod 12 and the piston includes a cross bore 74 for the gudgeon pin 14 and a recess 75 for the sealing element 20. An annular recess 75 is formed radially inwardly into the lateral surface of the piston with the depth of the recess being such that a breaking web 76 is formed between the base of the recess and the bore 73.

In the embodiments illustrated in FIGS. 6 and 7, it is advantageous if the circumferential edges 68, 77 of the headpieces 65, 72, respectively, are rounded off to prevent racking of the headpiece in the cylinder 4 when the headpiece is separated from the remainder of the first piston.

Figure 8:
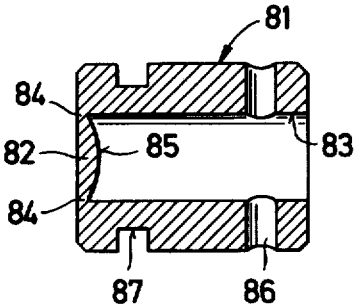

In FIG. 8 a further embodiment of the invention is shown by a drive piston 81 for use with a second piston 21 having a projection 23*a*, as shown in FIGS. 1 and 2. In this embodiment, the front transverse end face of the headpiece 82 directed toward the second piston 21 is flat or planar. By imparting a convex shape to the rearwardly facing surface of the headpiece which defines the closure of the bore 83, a breaking web 84 is formed at the juncture at the headpiece with the surface of the bore 83. The rearwardly facing surface of the headpiece or the closed end of the bore 83 forms the convex surface 85. The diameter of the headpiece is defined by the diameter of the bore 83. In addition, a cross bore is provided through the rearward end of the piston for the gudgeon pin 14 and a recess 87 is provided in the outer surface of the piston for the sealing element 20.

The arrangement disclosed in the above embodiments can also be used in chisel hammers which do not have rotary drives.

While specific embodiments of the invention have been shown and described in detail to illustrate the application of the inventive principles, it will be understood that the invention may be embodied otherwise without departing from such principles.

We claim:

1. Hammer drill comprising a sleeve forming an axially extending bore having a front end and rear end, a first piston located within said bore, means connected to said first piston for reciprocating said first piston in the axial direction of the bore, a second piston located within said bore between the front end thereof and said first piston, and said first and second pistons disposed in axially spaced relation forming in combination with the said bore an air cushion therebetween, said first piston comprises walls forming a hollow cylinder having the axis thereof disposed in parallel relation with the axis of said bore, said hollow cylinder having a front end closer to said second piston and a rear end closer to the rear end of said bore, said walls include a headpiece extending across the front end of said hollow cylinder for forming an airtight closure for the hollow chamber so that the air cushion in the bore is sealed from the hollow cylinder, wherein the improvement comprises that said headpiece includes a separable part, and a predetermined breaking line formed in one of said walls and said headpiece so that said separable part separates from the remainder of said first piston when said second piston strikes against said headpiece for forming an opening between said hollow cylinder and the air cushion in the interior of said sleeve.

2. Hammer drill, as set forth in claim 1, wherein the predetermined annular breaking line is formed in said headpiece so that said separable part separates from the remainder of said headpiece about the breaking line.

3. Hammer drill, as set forth in claim 1, wherein said headpiece having an annular recess formed therein providing a web interconnecting said separable part to one of the remainder of said headpiece and said walls forming the hollow chamber, said web has a reduced thickness compared to the thickness of the remainder of said separable part and forms the breaking line so that said separable part separates around said annular recess.

4. Hammer drill, as set forth in claim 3, wherein said headpiece comprises a planar surface extending transversely of the axis of said hollow cylinder and facing toward said second piston, a projection extending in the axial direction of said hollow cylinder from said planar surface toward said second piston so that said second piston strikes said projection for commencing the separation of said separable part from said first piston.

5. Hammer drill, as set forth in claim 3, wherein said headpiece comprises a planar surface extending transversely of the axis of said hollow cylinder and facing toward said second piston, said second piston having a transverse end surface facing toward said first part and forming one of the boundary surfaces of the air cushion, a projection extending in the axial direction of said hollow cylinder from the transverse end surface of said second piston and arranged to contact said headpiece for aiding in the separation of said separable part.

6. Hammer drill, as set forth in claim 1, wherein said headpiece having an opening therethrough extending between the interior of said hollow cylinder and the air cushion between said first and second pistons, and said separable part comprises a plug displaceably secured in the opening in said headpiece so that it forms a seal between the interior of said hollow cylinder and the air cushion, and the surface of the opening forms the breaking line along which said plug separates from said headpiece.

7. Hammer drill, as set forth in claim 6, wherein said plug extends from said headpiece in the axial direction of said hollow cylinder toward said second piston forming a projection to be contacted by said second piston.

8. Hammer drill, as set forth in claim 3, wherein said headpiece comprises a planar surface extending transversely of the axis of said hollow cylinder, and said annular recess formed in said planar surface and extending inwardly into said headpiece from the planar surface.

9. Hammer drill, as set forth in claim 3, wherein said headpiece comprises a planar surface extending transversely of the axis of said hollow cylinder, an annular surface concentric with the axis of said hollow cylinder and forming the radially outer circumferential periphery of said planar surface, said annular surface extending in the axial direction of said hollow cylinder, and said annular recess extending radially inwardly into said annular surface adjacent said planar surface.

10. Hammer drill, as set forth in claim 8, wherein said planar surface extends perpendicularly of the axis of said hollow cylinder.

11. Hammer drill, as set forth in claim 9, wherein said planar surface extends at an oblique angle to the axis of said hollow cylinder.

12. Hammer drill, as set forth in claim 9, wherein at least the part of said annular surface extending from said planar surface being rounded in the axial direction of said first piston.

13. Hammer drill, as set forth in claim 2, wherein said separable part having a convex surface located across the axis of the hollow cylinder and facing toward the rear end of said bore, and the radially outer edge of said convex surface defining the annular breaking line for said separable part.

* * * * *